US008424595B2

(12) United States Patent
Sach

(10) Patent No.: US 8,424,595 B2
(45) Date of Patent: Apr. 23, 2013

(54) METHOD AND APPARATUS FOR RELEASING A COILED TUBING INTERNAL CONDUIT FROM A BOTTOM HOLE ASSEMBLY

(71) Applicant: Manfred Sach, Calgary (CA)

(72) Inventor: Manfred Sach, Calgary (CA)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 13/651,687

(22) Filed: Oct. 15, 2012

(65) Prior Publication Data

US 2013/0037269 A1 Feb. 14, 2013

Related U.S. Application Data

(63) Continuation of application No. 12/844,565, filed on Jul. 27, 2010.

(60) Provisional application No. 61/230,260, filed on Jul. 31, 2009.

(51) Int. Cl.
*E21B 29/04* (2006.01)

(52) U.S. Cl.
USPC ..... 166/54.5; 166/55; 166/298; 166/318; 166/377

(58) Field of Classification Search ..... 166/54.5–54.6, 166/298, 55, 318, 377
See application file for complete search history.

(56) References Cited

U.S. PATENT DOCUMENTS

| | | | | |
|---|---|---|---|---|
| 4,660,635 | A * | 4/1987 | Wittrisch | 166/54.5 |
| 5,419,399 | A | 5/1995 | Smith | |
| 5,947,198 | A | 9/1999 | Mckee et al. | |
| 6,571,879 | B1 | 6/2003 | Bebak et al. | |
| 7,114,563 | B2 * | 10/2006 | Rose | 166/254.2 |

OTHER PUBLICATIONS

Office Action issued in U.S. Appl. No. 12/844,565 dated Sep. 20, 2012.
Final Office Action issued in U.S. Appl. No. 12/844,565 dated Feb. 1, 2013.

* cited by examiner

*Primary Examiner* — Giovanna Wright
(74) *Attorney, Agent, or Firm* — Parsons Behle & Latimer

(57) ABSTRACT

A method and apparatus for releasing a coiled tubing internal line from a bottom hole assembly. The internal line may not have strength sufficient to permit the application of a tension force at the surface to disconnect the internal line from the bottom hole assembly. The bottom hole assembly may include a ball seat adapted to retain a ball permitting the application of a pressure differential above and below the ball seat. An anchor assembly connected to the internal line may be adapted to disconnect from the bottom hole assembly upon the application of predetermined pressure differential. A predetermined pressure differential may be used to shear a portion of the internal line releasing an upper portion of the internal line from the bottom hole assembly.

6 Claims, 4 Drawing Sheets

METHOD AND APPARATUS FOR RELEASING A COILED TUBING INTERNAL CONDUIT FROM A BOTTOM HOLE ASSEMBLY

RELATED APPLICATIONS

This application is a divisional of U.S. patent application Ser. No. 12/844,565, filed Jul. 27, 2010, and entitled "Method and Apparatus for Releasing a Coiled Tubing Internal Conduit from a Bottom Hole Assembly" which claims the benefit of U.S. Provisional Patent Application No. 61/230,260, filed on Jul. 31, 2009, the disclosures of which are hereby incorporated by reference in their entirety.

BACKGROUND

1. Field of the Disclosure

The present disclosure relates generally to an apparatus and method for releasing a coiled tubing internal conduit(s) or line(s) from a bottom hole assembly. An anchor assembly may connect the internal conduit or line to a bottom hole assembly that is connected to the coiled tubing.

2. Description of the Related Art

Coiled tubing is used in various operations and maintenance tasks for oil and gas wells. Some of the coiled tubing applications involve the use of a conduit or line located inside of the coiled tubing, herein after referred to as an internal line. The internal line may be used to communicate between the surface and a bottom hole assembly or downhole tool. The communications provided by the internal line may be electrical, fiber optic, hydraulic, and/or mechanical in nature. The internal line may also be used to control and/or operate various functions of a downhole tool or bottom hole assembly.

Due to the length of coiled tubing strings and nature of the various applications for which coiled tubing strings are used, both the coiled tubing and the internal line may experience an overall change in length. This change in length may be due to temperature, mechanical, and/or hydraulic effects, or combinations of those effects. Often the internal line is anchored to a bottom hole assembly in an effort to minimize potential operational difficulties of working with a coiled tubing string and an internal line having different lengths.

One potential problem of performing various operations with coiled tubing is due to the small clearances between the coiled tubing and/or the bottom hole assembly and the casing/tubing. Because of the small clearances and also quite often wellbore conditions which involve debris or junk, it is possible for the bottom hole assembly or the coiled tubing to become stuck or wedged in the casing/tubing. Stuck coiled tubing or coiled tubing connected to a stuck bottom hole assembly may prevent the coiled tubing from being retrieved again from the wellbore, or the proper closure of a downhole safety valve (if installed) presenting possible safety issues. If efforts are unsuccessful to remove the stuck bottom hole assembly and/or coiled tubing from the wellbore, one option is to cut the coiled tubing at a predetermined depth and remove the upper portion or nearly all of it from the wellbore. A cutting tool may be run on a wireline down the coiled tubing to the predetermined depth to cut the coiled tubing. The removal of the cut upper portion of the coiled tubing allows the subsurface safety valve (if installed) to close while leaving the bottom hole assembly and a possible lower portion of the coiled tubing in the wellbore.

If an internal line is present in the coiled tubing, the internal line needs to be removed prior to running in the cutting tool on the wireline. Conventionally, the internal line has been removed by pulling on the internal line at the surface. The force required to disconnect the internal line must exceed the weight of the internal line plus the force used to anchor the internal line to the bottom hole assembly. This amount of force can reach in excess of 10,000 pounds. In deep and deviated wells, the force required to disconnect the internal line from the bottom hole assembly may approach or exceed the ultimate tensile strength of the internal line. The conventional method of disconnecting and removing the internal line limits the type and size of internal line that may be used within a coiled tubing string. The conventional disconnecting method requires a relatively strong internal line, which may result in using an internal line with a larger diameter and thus, smaller flow area within the coiled tubing string.

Depending on the application, the preferred internal line may not have the ultimate tensile strength required to disconnect from the bottom hole assembly by the conventional method. For example, the internal line may be a small diameter wire or capillary tube. While the internal line needs to have a strength sufficient enough to supports its own weight over its entire length, the internal line may not have sufficient strength to permit the application of a tension force at the surface to disconnect the internal line from the bottom hole assembly. For example, a preferred internal line for a specific application may only have an ultimate tensile strength of 1150 lbs or less, which is not sufficient to permit disconnection by pulling on the internal line at the surface. The application of a tension force at the surface in an effort to disconnect the internal line from the bottom hole assembly may instead cause the internal line to break potentially leaving length of the internal line within the coiled tubing that is still connected to the bottom hole assembly. The presence of the internal line in the coiled tubing may prevent the use of a wireline cutting tool to cut off the coiled tubing at the predetermined depth, which may be below the subsurface safety valve, if one is installed.

The present disclosure is directed to overcoming, or at least reducing the effects of, one or more of the issues set forth above.

SUMMARY OF THE DISCLOSURE

The following presents a summary of the disclosure in order to provide an understanding of some aspects disclosed herein. This summary is not an exhaustive overview, and it is not intended to identify key or critical elements of the disclosure or to delineate the scope of the invention as set forth in the appended claims.

One embodiment of the present disclosure is a system to selectively connect an internal line within coiled tubing to a bottom hole assembly, which is also connected to the coiled tubing. The system includes an anchor assembly selectively connected to the bottom hole assembly. The internal line is connected to the bottom hole assembly via the anchor assembly. The system also includes a piston that is movable between a first position and a second position. The piston is selectively connected to the anchor assembly. A shearable device, such as a shear pin, is configured to retain the piston in its first or initial position. Alternatively, a burstable device may be used to retain the piston in its initial position. A predetermined pressure differential may be applied to the piston causing the shearable device to shear, or alternatively the burstable device to burst, which permits the movement of the piston to its second position. The movement of the piston to its second position releases the anchor assembly, which is connected to the internal line, from the bottom assembly. The anchor assembly and the internal line may then be removed from the wellbore.

The internal line of the system may be a conduit, wire, capillary tube, cable, hydraulic line, fiber optic cable, or solid rod. The system may further include a seat that is adapted to retain an object to prevent fluid flow through the bottom hole assembly, which permits the pumping of fluid down the coiled tubing to increase a pressure differential above the seat. The seat may be a ball seat adapted to retain a ball pumped down the coiled tubing. The ball seat may be located on a portion of the bottom hole assembly.

One embodiment of the present disclosure is a system to selectively release a portion of an internal line within coiled tubing that is connected to a bottom hole assembly. The internal line and the coiled tubing are both connected to the bottom hole assembly. The system includes a shearing device that is selectively retained in an initial position adjacent the internal line. The shearing device may be selectively connected to a portion of the bottom hole assembly. A portion of the internal line may pass through the shearing device, which may be a shear button, a shear piston, or a shear ring. The system includes a ball seat adapted to retain a ball to prevent flow through the bottom hole assembly, which allows the pumping of fluid down the coiled tubing to increase a pressure differential at the shearing device. At a predetermined pressure, the shearing device is adapted to move from its initial position and shear the internal line, which releases the upper portion of the internal line from the bottom hole assembly. Alternatively, a burstable device may be used in place of the shearing device. The burstable device may be adapted to burst at the predetermined pressure shearing the internal line to release it from the bottom hole assembly.

One embodiment of the present disclosure is a method of releasing an internal line within coiled tubing from a bottom hole assembly, which is also connected to the coiled tubing. The method includes pumping an object down the coiled tubing. To pump the object down the coiled tubing, the coiled tubing may be cut at the surface. The object pumped down the coiled tubing may be a ball. The method also includes seating the object on a seat portion of the bottom hole assembly, which prevents fluid flow through the bottom hole assembly. The method further includes pumping fluid down the coiled tubing to increase the pressure within the coiled tubing, which creates a pressure differential above and below the seated object. The method includes releasing the internal line from the bottom hole assembly at a predetermined pressure differential within the coiled tubing.

The internal line may be released from the bottom hole assembly by moving a piston of an anchor assembly, which releases the anchor assembly from the bottom hole assembly. The internal line have been connected to the bottom hole assembly via the anchor assembly. Alternatively, the application of the predetermined pressure differential may shear off the internal line releasing it from the bottom hole assembly. The internal line may be sheared off above the bottom hole assembly by a shearable device or a burstable device.

Figure 1:
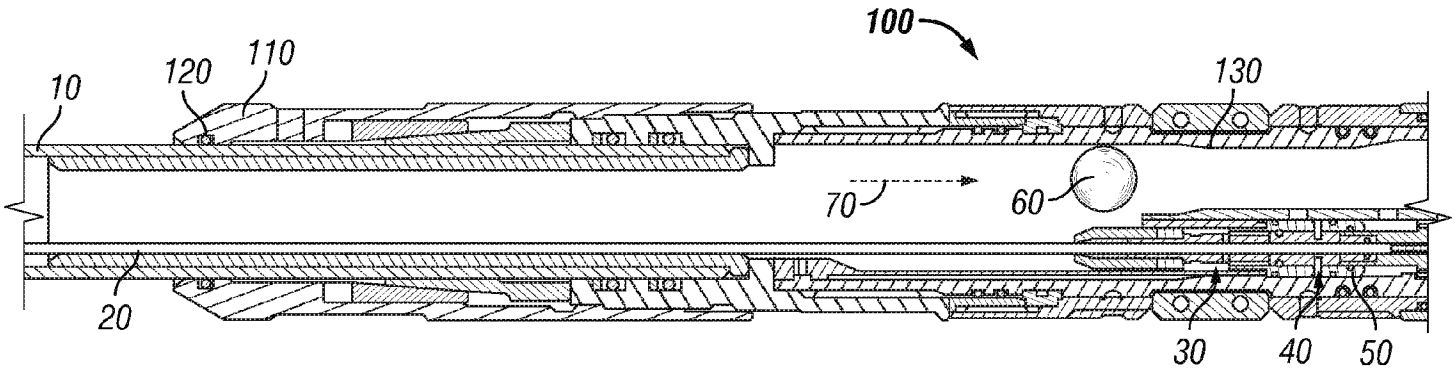
FIG. 1 illustrates cross-sectional view of an anchor assembly selectively connecting an internal conduit of coiled tubing to a bottom hole assembly, according to an embodiment of the present disclosure.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the invention as defined by the appended claims.

DETAILED DESCRIPTION

FIG. 1 illustrates coiled tubing 10 connected to a bottom hole assembly 100 by a coiled tubing grapple 110. A sealing element 120 seals the interface between the outer surface of the coiled tubing 10 and the connector 110. The coiled tubing grapple 110 is shown for illustrative purposes as various connectors may be used to connect the coiled tubing 10 to the bottom hole assembly 100. An internal line 20 is contained within the inner diameter of the coiled tubing 10. The internal line 20 may provide bidirectional communication between the bottom hole assembly 100 and the surface. The internal line 20 may provide operation and/or control of the bottom hole assembly 100 and/or a downhole tool. The internal line 20 may be a conduit, wire, capillary tube, cable, hydraulic line, fiber optic cable, a solid rod, or other line that may be used to provide communication between the surface and the bottom hole assembly as would be appreciated by one of ordinary skill in the art having the benefit of this disclosure. The internal line 20 may provide electrical, fiber optic, hydraulic, and/or mechanical communications between the bottom hole assembly 100 and the surface.

An anchor assembly 30 selectively secures the internal line 20 to a portion of the bottom hole assembly 100. The internal line 20 is mechanically connected to the anchor assembly 30. The internal line 20 may be connected to the anchor assembly 30 by a wedge lock connector, a grapple connector, or various other mechanical connectors as would be appreciated by one of ordinary skill in the art. The anchor assembly 30 may include a movable piston 50, which may be retained in an initial position by a shearable device, such as a shear pin 40. The shear pin 40 prevents the movement of the piston 50 and secures the anchor assembly 30 to the bottom hole assembly 100. Alternatively, a burstable device, such as a burst disc, may be used to retain the piston 50 in its initial position. The burstable device can be a thin foil of metal with a predetermined burst rating. As discussed below, the burstable device may be adapted to release the piston upon the increase to a predetermined pressure differential.

In the event that the bottom hole assembly 100 becomes stuck within the wellbore, it may be necessary to remove the internal line 20 from the coiled tubing 10. After the internal line 20 has been removed from the coiled tubing 10, additional efforts may be taken to remove the coiled tubing 10 from the wellbore such as running a cutting tool down the coiled tubing 10 to cut the coiled tubing 10 off immediately above the bottom hole assembly 100 or at a predetermined depth allowing the upper portion of the coiled tubing 10 to be removed from the wellbore. As discussed above, the internal line 20 may not have sufficient ultimate tensile strength to permit a tension force at the surface to disconnect the internal line 20 from the anchor assembly 30. The anchor assembly 30 shown in FIG. 1 is configured to disconnect from the bottom hole assembly 100 upon the application of a predetermined pressure differential. Illustrative examples of applying differential pressure to release the internal line 20 are detailed below.

Figure 2:
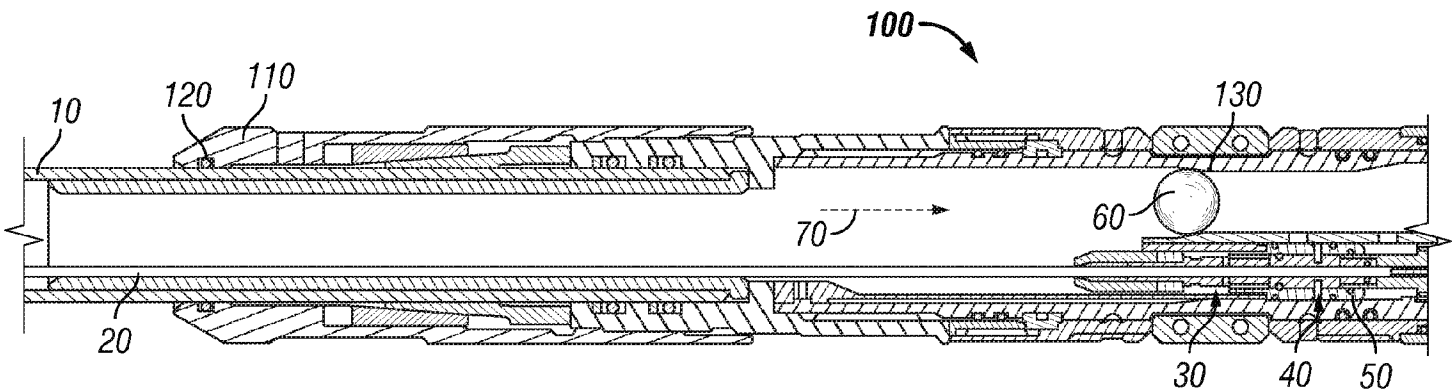
FIG. 2 illustrates the anchor assembly of FIG. 1 with a ball seated within a portion of the bottom hole assembly.

In order to disconnect the anchor assembly 30, the coiled tubing 10 may be cut at the surface and an object, such as a ball 60, may be dropped into the coiled tubing 10. The ball 60 is then pumped down towards (as indicated by arrow 70) the bottom hole assembly 100. The bottom hole assembly 100 includes a ball seat 130 adapted to retain the ball 60 and prevent fluid flow past the seated ball 60 (shown in FIG. 2) into the bottom hole assembly 100. An increase in pressure at the surface indicates when the ball 60 is seated on the seat 130. Once seated, fluid may be pumped down the coiled tubing 10 to increase the pressure to a predetermined amount at the anchor assembly 30. For example, the pressure may be typically increased between 1000 psi to 5000 psi or as required. However, the actual pressure differential may be varied depending on the application as would be appreciated by one of ordinary skill in the art. The pressure differential within the coiled tubing 10 is exerted on the upper portion of the piston 50 of the anchor assembly 30. The shear pin 40 selectively retains the piston in its initial position (shown in FIG. 1 and FIG. 2) until the pressure differential provides sufficient force on the piston 50 to shear the shear pin 40. The shear pin 40 may be designed to shear at a predetermined amount of force as will be appreciated by one of ordinary skill in the art having the benefit of this disclosure. As discussed above, a burstable device may be used in place of the shear pin 40 to selectively retain the piston 50 in its initial position.

Figure 3:
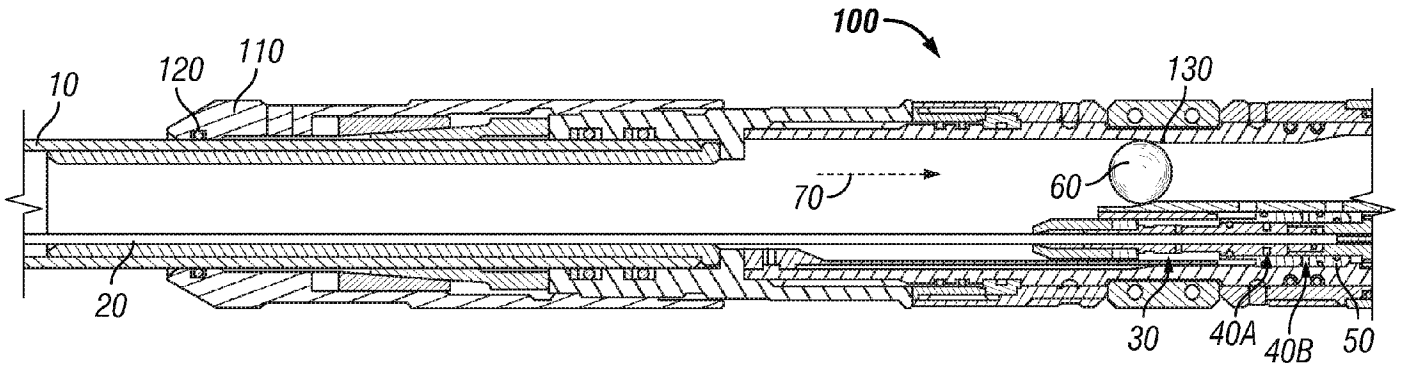
FIG. 3 illustrates the anchor assembly of FIG. 1 with the release sleeve of the anchor assembly being shifted to release a portion of the anchor assembly from the bottom hole assembly.
Figure 4:
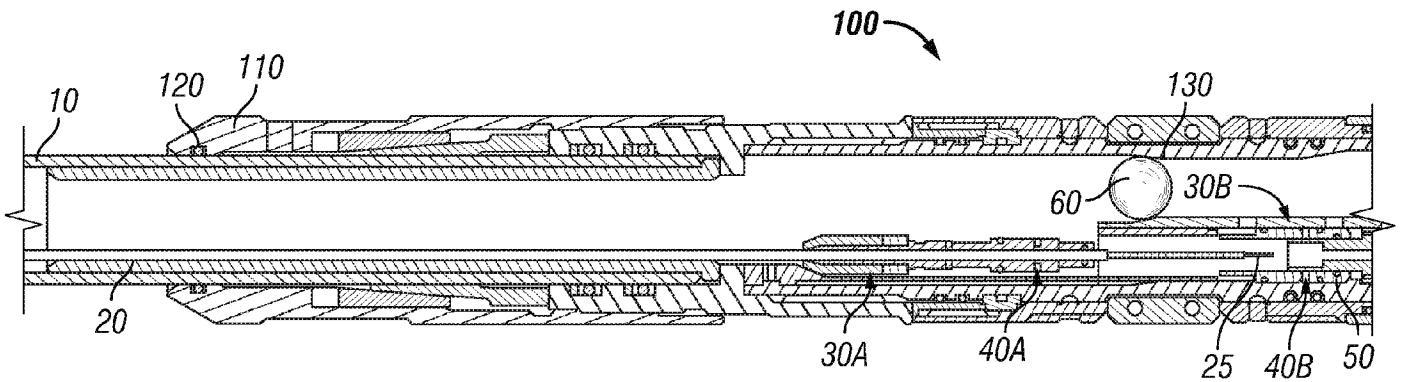
FIG. 4 illustrates the internal conduit and a portion of the anchor assembly being removed from the coiled tubing.

Once the amount of force exerted on the piston 50 is sufficient to shear the shear pin 40A, 40B (shown in FIG. 3) the piston 50 will move downhole away from its initial position. The shearing of the shear pin 40A, 40B releases a portion of the anchor assembly 30A from a portion 30B that remains connected to the bottom hole assembly 100, as shown in FIG. 4. A pressure drop at the surface or signal transmitted by the conduit will indicate when the shear pin 40 has sheared and the piston 50 has moved from its initial position. The internal line 20 may now be pulled at the surface to remove it from the coiled tubing 10. The lower portion of the internal line 20 may be connected to a wire 25 that is pulled out of a lower connector, which may provide communications between a downhole location and the surface when connected.

Figure 5:
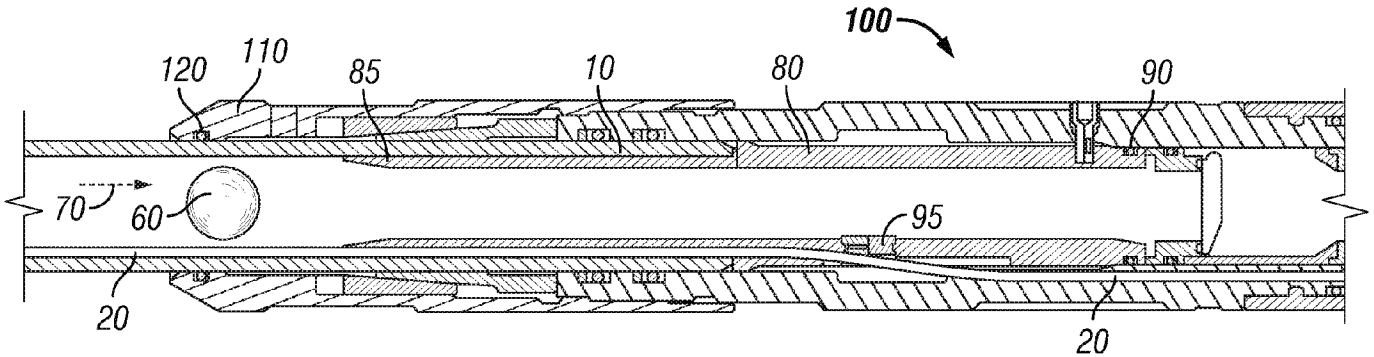
FIG. 5 illustrates a cross-sectional view of a system that is may be used to potentially shear an internal conduit of coiled tubing, according to an embodiment of the present disclosure.
Figure 6:
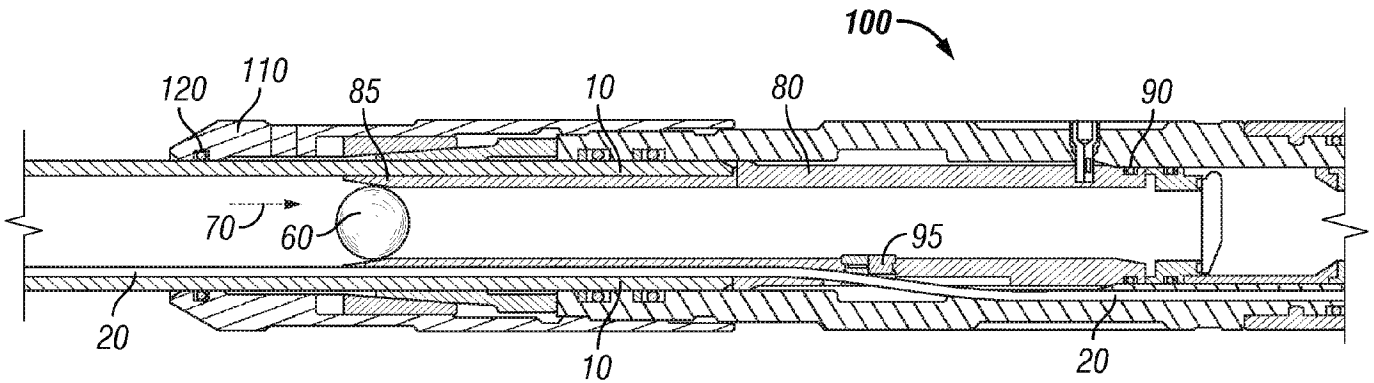
FIG. 6 illustrates a ball seated on a seating portion of the system of FIG. 5, which permits a differential pressure to be applied across a shearing or burstable device.

FIG. 5 shows an embodiment that may be used to shear the internal line 20 in order to release the internal line 20 from the bottom hole assembly 100. An object, such as a ball 60, may be pumped down the coiled tubing 10, in the event it becomes necessary to remove the internal line 20 from within the coiled tubing 10. As discussed above, the internal line 20 may not have sufficient ultimate tensile strength to be removed by a tension force at the surface. The ball 60 will be seated on a ball seat 85 of an internal sleeve 80 located within the bottom hole assembly 100, as shown in FIG. 6. The seated ball 60 prevents fluid from flowing downhole into the interior of the bottom hole assembly 100. The location of the ball seat 85 is for illustrative purposes only as the ball seat 85 may be located at various points along the length of the bottom hole assembly 100. An increase in pressure at the surface will indicate when the ball 60 has become seated on the ball seat 85.

Figure 7:
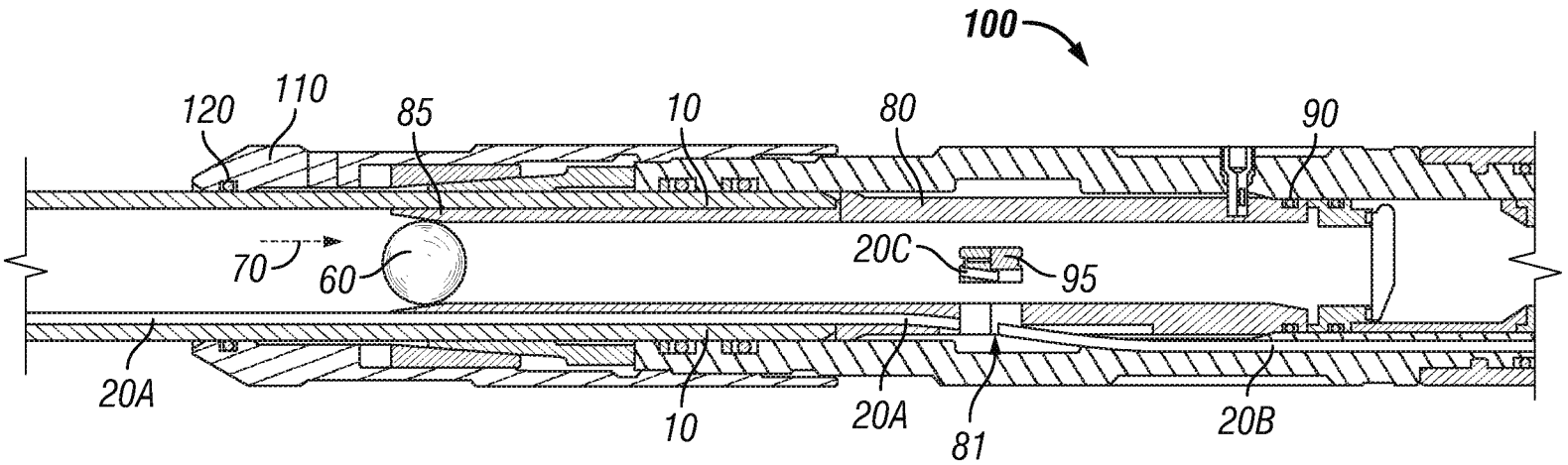
FIG. 7 illustrates the internal conduit being removed from the coiled tubing after being sheared by the shearing device shown in FIG. 6.

Fluid may then be pumped down the coiled tubing 10 to increase the pressure differential above and below the seated ball 60. The pressure differential will be exerted on the exterior surface of the sleeve 80 between the sleeve 80 and the coiled tubing 10. A sealing element 90 located between the lower exterior end of the sleeve 80 permits the increase in pressure to be exerted on the exterior of the sleeve 80. The pressure differential will exert an inward force on the exterior of the shearing device 95, which is positioned within an opening 81 (shown in FIG. 7) of the sleeve 80. The shearing device 95 is retained in an initial position (shown in FIG. 5 and FIG. 6) adjacent to the internal line 20. The internal line 20 may be connected to the shearing device 95 or alternatively, the internal line 20 may pass through a portion of the shearing device 95, as shown in FIG. 5-FIG. 7.

Due to the seating of the ball 60, there is a pressure differential between the coiled tubing 10 above the ball 60 and the interior of the bottom hole assembly 100. The pressure differential between the exterior of the sleeve 80 and the interior of the bottom hole assembly 100 exerts an inward force on the shearing device 95. The shearing device 95 may be adapted to move out of the opening 81 and into the interior of the bottom hole assembly 100 when the differential pressure is increased to a predetermined amount. The movement of the shearing device 95 shears a portion 20C of the internal line 20. Alternatively, a burstable device may be used to shear a portion of the internal line 20 upon the increase to a predetermined pressure differential. The shearing of the internal line 20 releases the internal line 20 from the bottom hole assembly 100 allowing an upper portion 20A to be pulled at the surface removing it from the coiled tubing 10. The lower portion 20B of the internal line 20 remains in the wellbore being connected to the bottom hole assembly 100. A small portion 20C of the internal line 20 may be retained in the shearing device 95, as shown in FIG. 7. A decrease in pressure at the surface indicates that the shearing device 95 has been pushed into the interior of the bottom hole assembly 100 shearing the internal line 20.

Although various embodiments have been shown and described, the disclosure is not so limited and will be understood to include all such modifications and variations as would be apparent to one skilled in the art.

What is claimed is:

1. A system to selectively release a portion of an internal line within coiled tubing connected to a bottom hole assembly, the system comprising:

the internal line within the coiled tubing being connected to the bottom hole assembly;

a shearing device selectively retained in an initial position adjacent the internal line, and a ball seat adapted to retain a ball to prevent flow through the bottom hole assembly;

wherein at a predetermined pressure the shearing device is adapted to move from the initial position and shear the internal line to release an upper portion of the internal line from the bottom hole assembly and wherein the shearing device is selectively connected to a portion of the bottom hole assembly.

2. The system of claim 1 wherein the shearing device is a shear button, shear piston, or shear ring.

3. A method of releasing an internal line within coiled tubing from a bottom hole assembly connected to the coiled tubing, the method comprising:

pumping an object down the coiled tubing;

seating the object on a seat portion of the bottom hole assembly, wherein the seated object prevents fluid flow through the bottom hole assembly;

pumping fluid down the coiled tubing to increase pressure within the coiled tubing; and releasing the internal line from the bottom hole assembly at a predetermined pressure within the coiled tubing, wherein releasing the internal line further comprises the predetermined pressure moving a shearing device to shear a portion of the internal line.

4. The method of claim 3 wherein the shearing device is a shearing button, shearing ring, or shearing piston.

5. The method of claim 3 wherein the internal line passes through a portion of the shearing device.

6. A system to selectively release a portion of an internal line within coiled tubing connected to a bottom hole assembly, the system comprising:

the internal line within the coiled tubing being connected to the bottom hole assembly;

a shearing device selectively retained in an initial position adjacent the internal line; and a ball seat adapted to retain a ball to prevent flow through the bottom hole assembly;

wherein at a predetermined pressure the shearing device is adapted to move from the initial position and shear the internal line to release an upper portion of the internal line from the bottom hole assembly and wherein the internal line passes through a portion of the shearing device.

* * * * *